US010335931B2

(12) United States Patent
Matsumoto et al.

(10) Patent No.: US 10,335,931 B2
(45) Date of Patent: Jul. 2, 2019

(54) IMPACT ROTATION TOOL

(71) Applicant: Panasonic Intellectual Property Management Co., Ltd., Osaka (JP)

(72) Inventors: Hiroshi Matsumoto, Mie (JP); Takechika Ishibashi, Shiga (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 515 days.

(21) Appl. No.: 15/014,243

(22) Filed: Feb. 3, 2016

(65) Prior Publication Data

US 2016/0229038 A1 Aug. 11, 2016

(30) Foreign Application Priority Data

Feb. 9, 2015 (JP) ..... 2015-023058

(51) Int. Cl.
*B25B 21/02* (2006.01)
*B25F 5/00* (2006.01)

(52) U.S. Cl.
CPC ..... *B25B 21/02* (2013.01); *B25F 5/006* (2013.01)

(58) Field of Classification Search
CPC ..... B25B 21/02; B25F 5/006
USPC ..... 173/162.2, 210
See application file for complete search history.

(56) References Cited

U.S. PATENT DOCUMENTS 3,476,960 A * 11/1969 Rees ..... H02K 7/145 174/138 D
3,908,139 A * 9/1975 Duncan, Jr. ..... B23B 45/001 173/217
4,081,704 A * 3/1978 Vassos ..... B25F 5/02 173/217
4,905,772 A * 3/1990 Honsa ..... B24B 23/02 173/162.1
5,394,039 A * 2/1995 Suchdev ..... B25D 17/24 173/162.2

(Continued)

FOREIGN PATENT DOCUMENTS

DE 20 2004 008 462 U1 10/2005
DE 10 2006 020 172 A1 11/2007

(Continued)

OTHER PUBLICATIONS

Extended European Search Report issued in corresponding European Patent Application No. 16154473.9, dated Jul. 6, 2016.

(Continued)

*Primary Examiner* — Michelle Lopez
(74) *Attorney, Agent, or Firm* — McDermott Will & Emery LLP

(57) ABSTRACT

An impact rotation tool includes a motor, an impact mechanism, and a housing, which covers the motor and the impact mechanism. The impact mechanism includes an output shaft, which is rotatable by the motor, and an anvil, which is rotatable integrally with the output shaft. The impact mechanism applies a striking impact to the anvil when the motor outputs rotation. The impact rotation tool further includes a motor seat and a vibration reducer. The motor seat is fastened to the motor to hold the motor in the housing. The vibration reducer is located in the housing to reduce striking vibration transmitted to the motor.

1 Claim, 4 Drawing Sheets

(56) References Cited

U.S. PATENT DOCUMENTS

| | | | | |
|---|---|---|---|---|
| 6,043,575 | A * | 3/2000 | Ghode | B25F 5/008 310/47 |
| 2001/0000882 | A1 | 5/2001 | Giardino et al. | |
| 2002/0096341 | A1 | 7/2002 | Hagan et al. | |
| 2004/0216907 | A1* | 11/2004 | Happ | B25F 5/006 173/217 |
| 2007/0246237 | A1 | 10/2007 | Homsi et al. | |
| 2007/0256847 | A1 | 11/2007 | Wan et al. | |
| 2009/0194306 | A1* | 8/2009 | Johnson | B25F 5/006 173/162.1 |
| 2011/0303726 | A1 | 12/2011 | Blessing et al. | |
| 2012/0187782 | A1 | 7/2012 | Esenwein | |

FOREIGN PATENT DOCUMENTS

| | | | |
|---|---|---|---|
| DE | 10 2009 028 247 | A1 | 2/2011 |
| EP | 2 397 267 | A2 | 12/2011 |
| JP | H08-118248 | A | 5/1996 |
| JP | 2002-103244 | A | 4/2002 |
| JP | 2010-076022 | A | 4/2010 |

OTHER PUBLICATIONS

Notification of Reasons for Refusal issued in corresponding Japanese Patent Application No. 2015-023058, dated Aug. 14, 2018; with English translation.

* cited by examiner

IMPACT ROTATION TOOL

CROSS-REFERENCE TO RELATED APPLICATIONS

This application is based upon and claims the benefit of priority from prior Japanese Patent Application No. 2015-023058, filed on Feb. 9, 2015, the entire contents of which are incorporated herein by reference.

FIELD

This disclosure relates to an impact rotation, tool and more specifically to an impact rotation tool including an impact mechanism that applies a striking impact to an anvil, which is rotated integrally with an output shaft when a motor outputs rotation.

BACKGROUND

Japanese Laid-Open Patent Publication No. 2010-76022 describes an impact rotation tool that uses an electric motor to tighten and loosen a fastening member such as a bolt. The impact rotation tool includes an impact mechanism that applies a striking impact to an anvil. The anvil is rotated integrally with an output shaft when the motor, which serves as a rotation drive source, rotates. In this type of impact rotation tool, the motor is fixed to a motor seat. The motor seat is held by a housing. The motor is radially and axially positioned by the motor seat and ribs of the housing. The impact mechanism converts the rotation from the motor into a rotation striking impact and transmits the rotation striking impact to the output shaft through the anvil. This transmits impact force to the output shaft, which rotates a bit, so that the fastening member is tightened or loosened with a higher torque.

A resin, a metal, or the like is used as the material of a plate forming the motor seat, which holds the motor. A resin, which may be injection-molded, is used as the material of the housing. When the motor seat and the housing are both a rigid body, striking vibration generated by the impact mechanism is transmitted to the motor without being attenuated at a portion of contact between the housing and the motor seat. Such vibration may cause breakage of a motor coil, breakage of a motor lead line, separation of a magnet, or the like.

SUMMARY

It would be desirable to provide an impact rotation tool capable of attenuating striking vibration that is transmitted to a motor.

One aspect of this disclosure is an impact rotation tool that includes a motor, an impact mechanism, a housing, a motor seat, and a vibration reducer. The motor serves as a rotation drive source. The impact mechanism includes an output shaft, which is rotatable by the motor, and an anvil, which is rotatable integrally with the output shaft. The impact mechanism applies a striking impact to the anvil when the motor outputs rotation. The housing covers the motor and the impact mechanism. The motor seat is fastened to the motor to hold the motor in the housing. The vibration reducer is located in the housing to reduce striking vibration transmitted to the motor.

This structure attenuates the striking vibration transmitted to the motor.

Other aspects and advantages of this disclosure will become apparent from the following description, taken in conjunction with the accompanying drawings, illustrating by way of example the principles of the invention.

BRIEF DESCRIPTION OF THE DRAWINGS

The embodiments, together with objects and advantages thereof, may best be understood by reference to the following description of the presently preferred embodiments together with the accompanying drawings in which.

DESCRIPTION OF THE EMBODIMENTS

One embodiment of an impact rotation tool will now be described.

Figure 1:
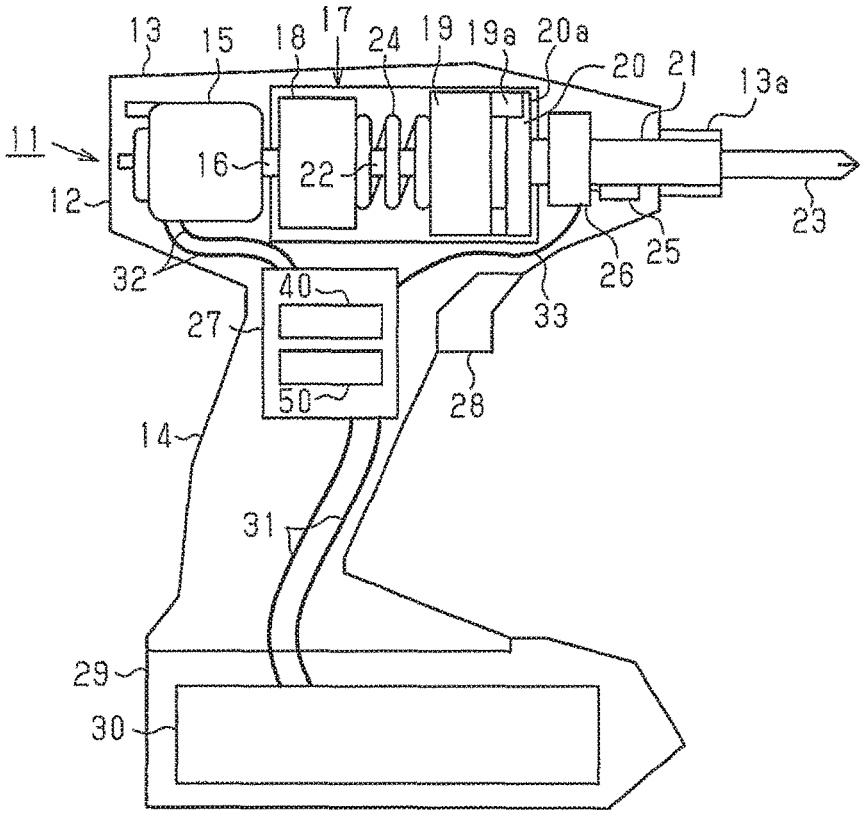
FIG. 1 is a schematic diagram illustrating the structure of an impact rotation tool.

As illustrated in FIG. 1, a grip-type impact rotation tool 11, which may be held by a single hand, is applied to, for example, an impact driver or an impact wrench. The impact rotation tool 11 includes a housing 12, which forms the exterior of the impact rotation tool 11. The housing 12 includes a tubular barrel 13 and a grip 14, which extends from the barrel 13 in one direction (in FIG. 1, downward) that intersects with the axis of the barrel 13.

The barrel 13 includes a basal portion (a portion located at the left side in FIG. 1), which accommodates a motor 15 serving as a rotation drive source. The motor 15 includes a motor output shaft 16. The motor output shaft 16 is aligned with the axis of the barrel 13 and directed toward the distal side of the barrel 13. The motor 15 is a DC motor, which may be a brushed motor or a brushless motor. The motor output shaft 16 is coupled to an impact mechanism 17.

In a first load state, in which load is relatively small, the impact mechanism 17 reduces the speed of the rotation from the motor 15 to increase torque. In a second load state, in which the load is relatively large, the impact mechanism 17 converts the rotations output from the motor 15 into impact torque to generate impact force. In the present embodiment, the impact mechanism 17 includes, for example, a reduction mechanism 18, a hammer 19, an anvil 20, which receives an impact from the hammer 19, and an output shaft 21, which rotates integrally with the anvil 20. The reduction mechanism 18 reduces the rotation, which is generated by the motor 15, at a predetermined reduction ratio to increase the torque. The rotation, which has been reduced by the reduction mechanism 18 and has high torque, is transmitted to the hammer 19. When the hammer 19 strikes the anvil 20, the rotation force is impulsively applied to the output shaft 21.

The hammer 19 is rotational relative to a drive shaft 22, which is rotated by the reduction mechanism 18, and able to slide along the drive shaft 22 in a front-rear direction. The hammer 19 is urged forward (in FIG. 1, rightward) by elastic force of a coil spring 24, which is located between the reduction mechanism 18 and the hammer 19. The urging force sets the hammer 19 in a position where the hammer 19 may contact the anvil 20. The anvil 20 includes a contact portion 20*a*, which radially extends. The hammer 19 includes two contact portions 19*a*, which may circumferentially contact the contact portion 20*a* of the anvil 20. When the contact portions 19*a*, 20*a* are in contact and the hammer 19 and the anvil 20 integrally rotate, the rotation, which has been reduced by the reduction mechanism 18, is transmitted from the drive shaft 22 to the output shaft 21, which is coaxial with the anvil 20. The barrel 13 includes a distal portion (in FIG. 1, left end), which includes a chuck 13*a*. The chuck 13*a* includes a socket slot (not illustrated), which receives a bit 23 in a removable manner.

The load applied to the output shaft 21 relatively increases when the fastening member such as a bolt is progressively fastened or the fastening member is loosened by the bit 23, which rotates integrally with the output shaft 21. When a predetermined or greater force is applied to the hammer 19 through the output shaft 21, the hammer 19 moves backward (in FIG. 1, leftward) along the drive shaft 22 as compressing the coil spring 24. Then, when the contact portions 19*a* of the hammer 19 and the contact portion 20*a* of the anvil 20 are released from the contact state, the hammer 19 freely rotates. However, due to the urging force of the coil spring 24, the hammer 19 immediately returns to a position where the hammer 19 may contact the anvil 20. Thus, when the contact portions 19*a* of the hammer 19 next contacts the contact portion 20*a* of the anvil 20, the hammer 19 strikes the anvil 20. Suck a strike of the hammer 19, which applies a large load to the output shaft 21, is repeated whenever the hammer 19 is separated from the anvil 20 and freely rotates against the urging force of the coil spring 24. Thus, the fastening member such as a bolt is fastened and loosened by the impact strike (impact torque) together with the rotation force.

A torque sensor 25 is attached to the output shaft 21 of the impact rotation tool 11. One example of the torque sensor 25 is a torsion sensor that is attached to the output shaft 21 and detects torsion. The torsion sensor detects torsion, which is formed due to the impact strike (impact torque) applied to the output shaft 21, and outputs a torque detection signal having a voltage that corresponds to the detected torsion. The torque detection signal is provided to a circuit substrate 27 (control circuit 40) through a slip ring 26, which is incorporated in the output shaft 21.

The grip 14 includes a trigger lever 28, which is operated by the user when driving the impact rotation tool 11. The circuit substrate 27 is accommodated in the grip 14. The circuit substrate 27 includes the control circuit 40 and a drive circuit 50, which respectively control and drive the motor 15. The grip 14 includes a lower end, to which a battery pack 29 is attached in a removable manner.

The circuit substrate 27 is connected to a rechargeable battery 30 included in the battery pack 29 by a power like 31 or the like and to the motor 15 by a power line 32 or the like. The circuit substrate 27 is also connected to the torque sensor 25 (slip ring 26) by a signal line 33 or the like. The circuit substrate 27 is also connected to a trigger switch (not illustrated), which detects an operation of the trigger lever 28.

The structure for holding the motor 15 will now be described.

Figure 2:
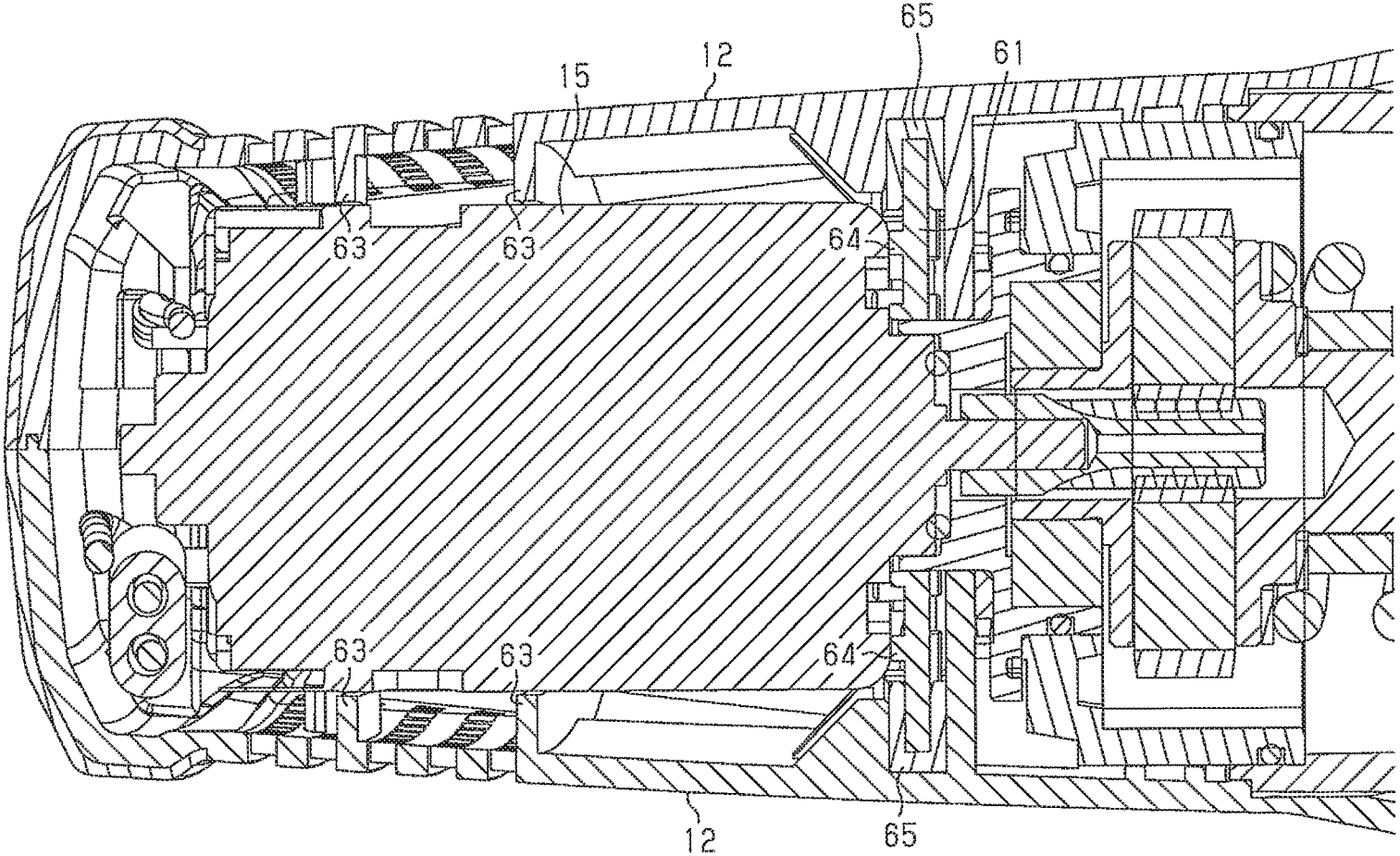
FIG. 2 is a cross-sectional view illustrating the structure for holding a motor.
Figure 3:
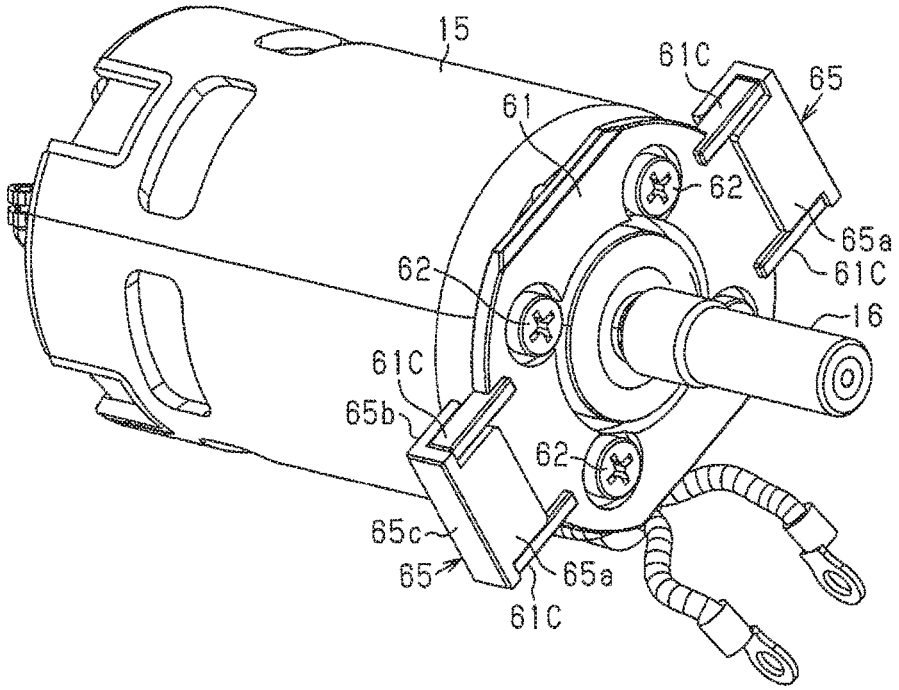
FIG. 3 is a perspective view illustrating motor vibration rubber guards covering a motor seat in the motor holding structure.
Figure 4:
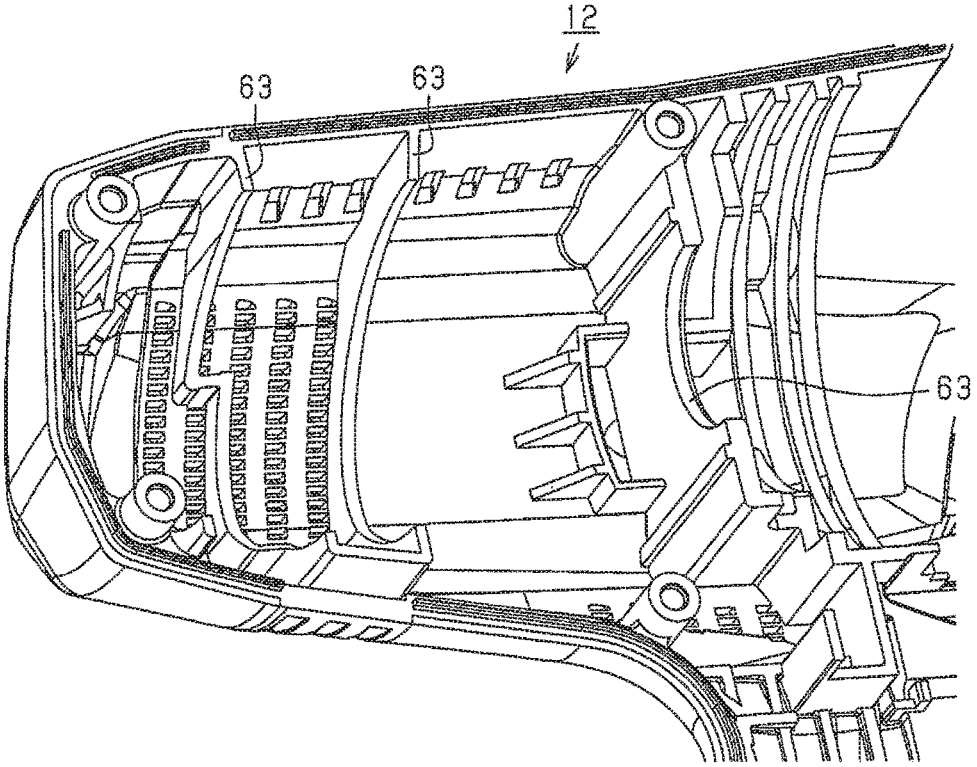
FIG. 4 is a perspective view illustrating ribs of a housing in the motor holding structure.

As illustrated in FIG. 2, the motor seat 61 is fastened to the motor 15 by a plurality of screws 62 (refer to FIG. 3). The motor seat 61 is held by the housing 12, which is formed, for example, by combining two molded components. The housing 12 covers the motor 15, the impact mechanism 17, and the like. The motor 15 is radially positioned, for example, by a plurality of ribs 63 (refer to FIG. 4), which radially extend from an inner wall of the housing 12, and the like. The motor 15 is axially positioned, for example, by a plurality of ribs 64, which axially extend from the motor seat 61, and the like. A resin, metal, or the like is used as the material of a plate forming the motor seat 61, which holds the motor 15 in the housing 12. A resin, which may be injection-molded, is used as the material of the housing 12. In the present embodiment, the housing 12 accommodates vibration reducers 65, which reduces striking vibration transmitted to the motor 15. The vibration reducers 65 are arranged, for example, at engagement portions of the housing 12 and the motor seat 61. For example, a motor vibration rubber guard, which is an elastic body, may be used as the vibration reducer 65. Hereafter, to facilitate understanding, the vibration reducer 65 may be referred to as the motor vibration rubber guard 65. The elastic body is not limited to a rubber (motor vibration rubber guard 65) and may be a different resin member or a spring.

Figure 5:
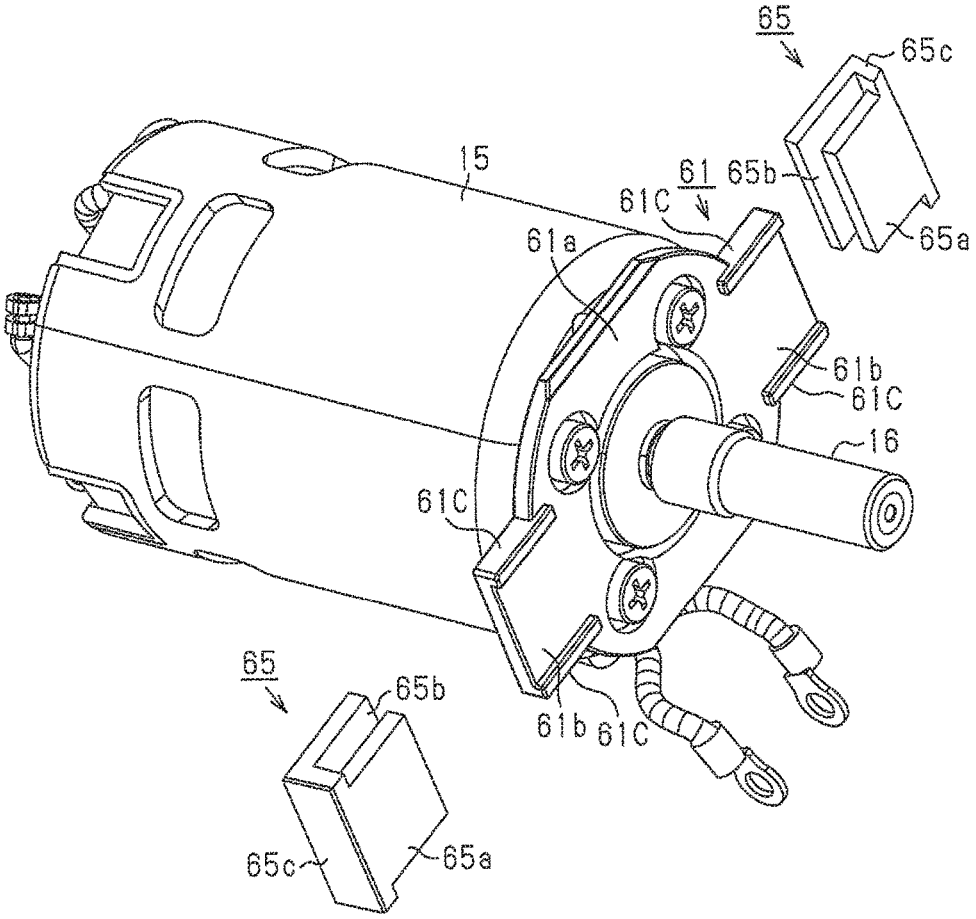
FIG. 5 is an exploded perspective view illustrating the motor seat, which is fixed to the motor, and the motor vibration rubber guards, which cover engagement portions of the motor seat.

As illustrated in FIG. 5, the motor seat 61 includes an annular body 61*a*, which includes a central portion provided with a circular opening, and two engagement portions 61*b*, which have a predetermined width and a predetermined thickness and extend radially outward from two radially opposite sides of the body 61*a*. The motor output shaft 16 is inserted into the circular opening of the body 61*a*. The thickness-wise direction of the engagement portions 61*b* conforms to the axial direction of the motor 15. The width-wise direction of the engagement portions 61*b* extends in the same direction as one of two axes defining a plane that extends in the radial direction of the motor 15. The extending direction of the engagement portions 61*b* conforms to the direction in which the other one of the two axes extend. The engagement portions 61*b* are each covered by the corresponding motor vibration rubber guard 65 from a radially outer side (refer to FIG. 3).

The motor vibration rubber guards 65 have the same shape. The motor vibration rubber guards 55 each include first to third elastic pieces 65*a*, 65*b*, 65*c* and have a substantially U-shaped cross-section. However, there is no limitation to such a configuration. The first elastic piece 65*a* covers the corresponding engagement portion 61*b* from one side in the axial direction. The second elastic piece 65*b*, which is separated parallel from the first elastic piece 65*a*, covers the corresponding engagement portion 61*b* from the other side in the axial direction. The third elastic piece 65*c*, which connects the first elastic piece 65*a* and the second elastic piece 65*b*, covers the engagement portion 61*b* from the radially outer side. The motor vibration rubber guards 65 do not include an elastic piece in the rotation direction of the motor 15. In the present embodiment, the motor seat 61 includes, for example, contact surfaces 61*c*, which contact the housing 12 in the rotation direction of the motor 15. The contact surfaces 61*c* are free from an elastic body (motor vibration rubber guard 65). In other words, each motor vibration rubber guard 65 includes slits that expose two opposite end surfaces (contact surfaces 61*c*) of the corresponding engagement portion 61*b* in the rotation direction of the motor 15. The two end surfaces of the engagement portion 61*b* are in direct contact with the housing 12. The motor seat 61 and the housing 12 both are a rigid body. Thus, the rigid bodies hold the motor 15 in the rotation direction.

The operation of the impact rotation tool 11 will now be described.

When the user operates the trigger lever 28, the motor 15 rotates. When a large load is applied to the output shaft 21, the impact mechanism 17 converts the rotations output from the motor 15 into a rotation striking impact and transmits the rotation striking impact to the output shaft 21 through the anvil 20. The striking generates a large vibration. The motor vibration rubber guards 65 are arranged between the housing 12 and the motor seat 61. The motor vibration rubber guards 65 reduce the striking vibration transmitted from the housing 12 to the motor seat 61. This reduces the vibration transmitted to the motor 15. Such reduction in the striking vibration transmitted to the motor 15 may prevent troubles such as breakage of the coil in the motor 15.

The contact surfaces 61*c*, which contact the housing 12 in the rotation direction of the motor 15, of the motor seat 61 are free from the elastic body (motor vibration rubber guard 65). Thus, the motor 15 is held in the rotation direction by the rigid bodies, that is, the motor seat 61 and the housing 12. This ensures the transmission of the torque from the motor 15 practically without being attenuated. Consequently, the rotation of the motor 15 reflects the rotation of the bit 23 with high efficiency, and the fastening member such as a bolt may be appropriately fastened and loosened.

The present embodiment has the advantages described below.

(1) The impact rotation tool 11 includes the vibration reducers 65 (in present example, motor vibration rubber guards 65), which reduce (decrease) the striking vibration transmitted to the motor 15. This prevents troubles caused by the striking vibration such as breakage of the coil in the motor 15.

(2) The vibration reducers 65 (in present example, motor vibration rubber guards 65) are arranged between the housing 12 and the motor seat 61. Thus, the vibration reducers 65 reduce the striking vibration, which are transmitted from the housing 12 to the motor seat 61, and prevent troubles such as breakage of the coil in the motor 15.

(3) The vibration reducers 65 are each an elastic body (in present example, motor vibration rubber guard 65) arranged between the housing 12 and the motor seat 61. In this configuration, the striking vibration transmitted from the housing 12 to the motor seat 61 is appropriately reduced by the elastic bodies. This further limits the transmission of the striking vibration to the motor 15 and ensures the preventions of troubles such as breakage of the coil in the motor 15.

(4) In the impact rotation tool 11, the contact surfaces 61*c*, which contact the housing 12 in the rotation direction of the motor 15, of the motor seat 61 are free from the elastic body (in present example, motor vibration rubber guard 65). In this configuration, the motor 15 is held in the rotation direction by the rigid bodies, that is, the motor seat 61 and the housing 12. This allows for the appropriate transmission of the torque of the motor 15 to rotate the bit 23.

It should be apparent to those skilled in the art that the foregoing embodiments may be employed in many other specific forms without departing from the scope of the invention. Particularly, it should be understood that the foregoing embodiments may be employed in the following forms.

The vibration reducers 65, which are arranged between the housing 12 and the motor seat 61, are not limited to an elastic body such as the motor vibration rubber guard 65. More specifically, as long as a component (e.g., component including a viscous member) provided as the vibration reducer 65 or a vibration damper is arranged between the housing 12 and the motor seat 61, the reduction in the striking vibration transmitted from the housing 12 is expected. This limits the transmission of the striking vibration to the motor 15 and prevents troubles such as breakage of the coil in the motor 15.

The material, the density, the thickness, or the like of the motor vibration rubber guard 65 may be changed in accordance with the level of attenuation required for the striking vibration transmitted from the housing 12.

When the motor 15 can transmit as much torque as needed for the impact mechanism 17, a rigid body or an elastic body which is formed from hard rubber or the like may be arranged between the motor seat 61 and the housing 12 in the rotation direction of the motor 15.

The shape of the motor vibration rubber guards 65 may be changed in conformance with the engagement portions of the housing 12 and the motor seat 61.

The impact rotation tool 11 may be appropriately changed to another configuration.

Clauses

This disclosure encompasses the following embodiments.

1. An impact rotation tool including:

a motor that serves as a rotation drive source;

an impact mechanism including an output shaft, which is rotatable by the motor, and an anvil, which is rotatable integrally with the output shaft, wherein the impact mechanism applies a striking impact to the anvil when the motor outputs rotation;

a housing that covers the motor and the impact mechanism;

a motor seat fastened to the motor to hold the motor in the housing; and a vibration reducer located in the housing to reduce striking vibration transmitted to the motor.

2. The impact rotation tool according to clause 1, wherein the vibration reducer is arranged between the housing and the motor seat.

3. The impact rotation tool according to clause 2, wherein the vibration reducer includes an elastic body.

4. The impact rotation tool according to clause 1, wherein the motor seat includes a contact surface that is contact with the housing in a rotation direction of the motor, and the contact surface is free from the vibration reducer.

The present examples and embodiments are to be considered as illustrative and not restrictive, and the invention is not to be limited to the details given herein, but may be modified within the scope and equivalence of the appended claims.

The invention claimed is:

1. An impact rotation tool comprising:

a motor that serves as a rotation drive source;

an impact mechanism including an output shaft, which is rotatable by the motor, and an anvil, which is rotatable integrally with the output shaft, wherein the impact mechanism applies a striking impact to the anvil when the motor outputs rotation;

a housing that covers the motor and the impact mechanism;

a motor seat fastened to the motor to hold the motor in the housing; and a vibration reducer arranged between the housing and the motor seat to reduce striking vibration transmitted to the motor, wherein:

the motor seat includes an annular body and two engagement portions, wherein the two engagement portions extend radially outward from two radially opposite sides of the body;

the vibration reducer includes two motor vibration rubber guards, wherein each of the motor vibration rubber guards covers a corresponding one of the engagement portions from a radially outer side;

each of the engagement portions includes contact surfaces which contact the housing in a rotation direction of the motor; and each of the motor vibration rubber guards includes slits that expose the contact surfaces of the corresponding engagement portion in the rotation direction of the motor.

* * * * *